US009056500B2

(12) United States Patent
Sanekata et al.

(10) Patent No.: US 9,056,500 B2
(45) **Date of Patent: *Jun. 16, 2015**

(54) IMAGE RECORDING APPARATUS AND IMAGE RECORDING METHOD

(71) Applicant: SEIKO EPSON CORPORATION, Tokyo (JP)

(72) Inventors: Takahito Sanekata, Shiojiri (JP); Daiki Tokushima, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/481,786

(22) Filed: Sep. 9, 2014

(65) Prior Publication Data

US 2014/0375719 A1 Dec. 25, 2014

Related U.S. Application Data

(63) Continuation of application No. 13/273,151, filed on Oct. 13, 2011, now Pat. No. 8,858,104.

(30) Foreign Application Priority Data

Oct. 19, 2010 (JP) ..... 2010-234714

(51) Int. Cl.

| | |
|---|---|
| ***B65H 20/10*** | (2006.01) |
| ***B41J 11/42*** | (2006.01) |
| ***B41J 11/00*** | (2006.01) |

(52) U.S. Cl.

CPC ..... *B41J 11/0085* (2013.01); *B65H 20/10* (2013.01); *B41J 11/42* (2013.01); *B41J 11/002* (2013.01)

(58) Field of Classification Search

USPC ..... 400/582

See application file for complete search history.

(56) References Cited

U.S. PATENT DOCUMENTS

| | | | |
|---|---|---|---|
| 4,268,841 | A | 5/1981 | Fujii et al. |
| 4,975,780 | A | 12/1990 | Kuboki |
| 5,635,963 | A | 6/1997 | Kuboki |
| 6,604,820 | B1 | 8/2003 | Fukuda |
| 7,562,975 | B2 | 7/2009 | Yokoyama et al. |

FOREIGN PATENT DOCUMENTS

| | | |
|---|---|---|
| JP | 2010-125830 | 6/2010 |

*Primary Examiner* — Jill Culler

(74) *Attorney, Agent, or Firm* — Workman Nydegger

(57) ABSTRACT

An image recording apparatus includes: a heating section which is located further on the downstream side of a transport pathway than an image recording area, but further on the upstream side of the transport pathway than a transport roller which is rotated by a motor; and a control section which lowers the suction power of a suction section to a medium from a first suction power to a second suction power lower than the first suction power during a recording operation and makes a first torque which is generated at the motor in a period which is during the recording operation and in which the suction power of the suction section is a suction power lower than the first suction power, be lower than a second torque which is generated at the motor during a transport operation.

5 Claims, 6 Drawing Sheets

IMAGE RECORDING APPARATUS AND IMAGE RECORDING METHOD

CROSS-REFERENCE TO RELATED APPLICATIONS

This application is a continuation application of U.S. patent application Ser. No. 13/273,151, filed Oct. 13, 2011, which patent application is incorporated herein by reference in its entirety. U.S. patent application Ser. No. 13/273,151 claims the benefit of Japanese Patent Application No. 2010-234714 filed Oct. 19, 2010, the contents of which is hereby incorporated by reference in its entirety.

BACKGROUND

1. Technical Field

The present invention relates to an image recording apparatus and an image recording method.

2. Related Art

As an image recording apparatus, there is a printer which prints an image by discharging ink from a head onto a medium such as paper. Among such printers, a printer is known in which the medium is supported by a platen such that the medium has a constant position with respect to the head, and the medium is suctioned from a suction hole provided at the platen such that the medium on the platen is held at a given position.

Further, a printer having a drying section (a heating section) which fixes an image to a medium by heating the medium with the image printed thereon has also been proposed (for example, JP-A-2010-125830).

At the time of transporting the medium, it is preferable if the suction power of the platen to the medium is lowered. In particular, by lowering the suction power of the platen during printing, it is possible to transport the medium immediately after printing is finished, so that it is possible to shorten the overall operational time. However, in a printer in which tension is imparted to the medium from the downstream side of a transport pathway of the medium also during printing, if the suction power of the platen is lowered during printing, when the medium contracts in a drying section, the medium on the platen is pulled to the drying section side. Then, the position of the medium on the platen is shifted during printing, so that the image quality of a printed image deteriorates.

SUMMARY

An advantage of some aspects of the invention is that it provides suppression of deterioration in the image quality of a recording image.

According to an aspect of the invention, there is provided an image recording apparatus including: (A) a recording section which records an image on a medium which is located at an image recording area; (B) a medium support section which supports the medium which is located at the image recording area, at a support surface in which an opening portion of a suction hole is provided; (C) a suction section which suctions the medium supported on the medium support section through the suction hole; (D) a transport section which transports the medium along a transport pathway by a transport roller and includes a motor which rotates the transport roller which is located further to the downstream side of the transport pathway than the image recording area; (E) a heating section which fixes the image recorded on the medium and is located further on the downstream side of the transport pathway than the image recording area, but further on the upstream side of the transport pathway than the transport roller which is rotated by the motor; and (F) a control section which repeatedly carries out a transport operation of the medium by the transport section and a recording operation of the image by the recording section, lowers the suction power of the suction section to the medium from a first suction power to a second suction power lower than the first suction power during the recording operation, and makes a first torque, which is generated at the motor in a period which is during the recording operation and in which the suction power of the suction section is a suction power lower than the first suction power, be lower than a second torque which is generated at the motor during the transport operation.

Other features of the invention will be apparent from the description of this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
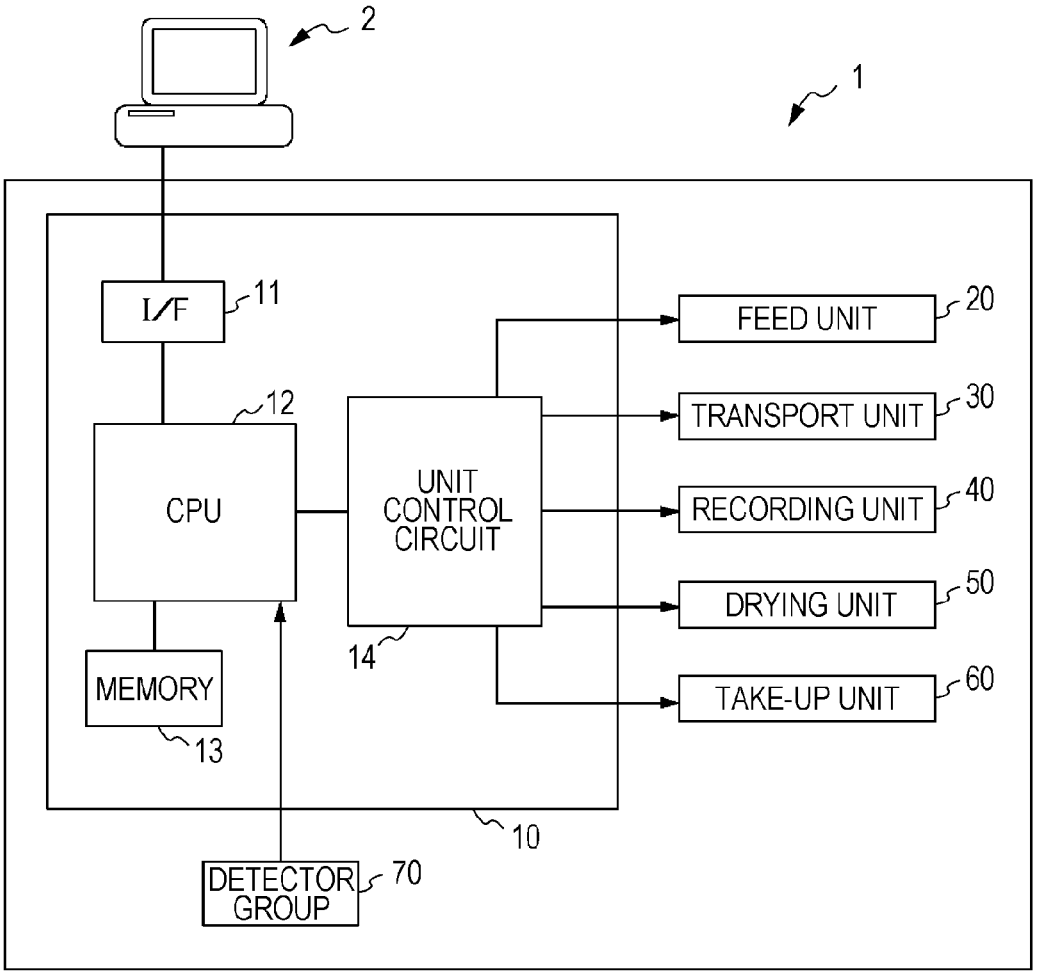
FIG. 1 is a block diagram of the overall configuration of a printer.

At least the following matters will become apparent by the descriptions of this specification and the accompanying drawings.

That is, an image recording apparatus includes: (A) a recording section which records an image on a medium which is located at an image recording area; (B) a medium support section which supports the medium which is located at the image recording area, at a support surface in which an opening portion of a suction hole is provided; (C) a suction section which suctions the medium supported on the medium support section through the suction hole; (D) a transport section which transports the medium along a transport pathway by a transport roller and includes a motor which rotates the transport roller which is located further on the downstream side of the transport pathway than the image recording area; (E) a heating section which fixes the image recorded on the medium and is located further on the downstream side of the transport pathway than the image recording area, but further on the upstream side of the transport pathway than the transport roller which is rotated by the motor; and (F) a control section which repeatedly carries out a transport operation of the medium by the transport section and a recording operation of the image by the recording section, lowers the suction power of the suction section to the medium from a first suction power to a second suction power lower than the first suction power during the recording operation, and makes a first torque which is generated at the motor in a period which is during the recording operation and in which the suction power of the suction section is a suction power lower than the first suction power, be lower than a second torque which is generated at the motor during the transport operation.

According to such an image recording apparatus, the shifting of the position of the medium supported on the medium support section during the recording operation can be prevented, so that it is possible to suppress deterioration in the image quality of a recording image.

In such an image recording apparatus, the control section may change a torque which is generated at the motor into the first torque after the end of the transport operation and before the start of the recording operation.

According to such an image recording apparatus, the shifting of the position of the medium supported on the medium support section during the recording operation can be prevented, so that it is possible to suppress deterioration in the image quality of a recording image.

In such an image recording apparatus, the control section may raise the suction power of the suction section from the second suction power to the first suction power after the end of the transport operation and change a torque which is generated at the motor into the first torque after the suction power of the suction section reaches the first suction power.

According to such an image recording apparatus, it is possible to suction and stick the medium to the medium support section in a state where the medium has tension.

Further, an image recording method includes: recording an image on a medium by using an image recording apparatus which includes (A) a recording section which records the image on the medium which is located at an image recording area; (B) a medium support section which supports the medium which is located at the image recording area, at a support surface in which an opening portion of a suction hole is provided; (C) a suction section which suctions the medium supported on the medium support section through the suction hole; (D) a transport section which transports the medium along a transport pathway by a transport roller and includes a motor which rotates the transport roller which is located further on the downstream side of the transport pathway than the image recording area; (E) a heating section which fixes the image recorded on the medium and is located further on the downstream side of the transport pathway than the image recording area, but further on the upstream side of the transport pathway than the transport roller which is rotated by the motor; and (F) a control section which repeatedly carries out a transport operation of the medium by the transport section and a recording operation of the image by the recording section, lowers the suction power of the suction section to the medium from a first suction power to a second suction power lower than the first suction power during the recording operation, and makes a first torque which is generated at the motor in a period which is during the recording operation and in which the suction power of the suction section is a suction power lower than the first suction power, be lower than a second torque which is generated at the motor during the transport operation.

According to such an image recording method, the shifting of the position of the medium supported on the medium support section during the recording operation can be prevented, so that it is possible to suppress deterioration in the image quality of a recording image.

Printer

Hereinafter, an embodiment will be described by taking an ink jet printer (hereinafter referred to as a printer) as an example of an "image recording apparatus".

Figure 2:
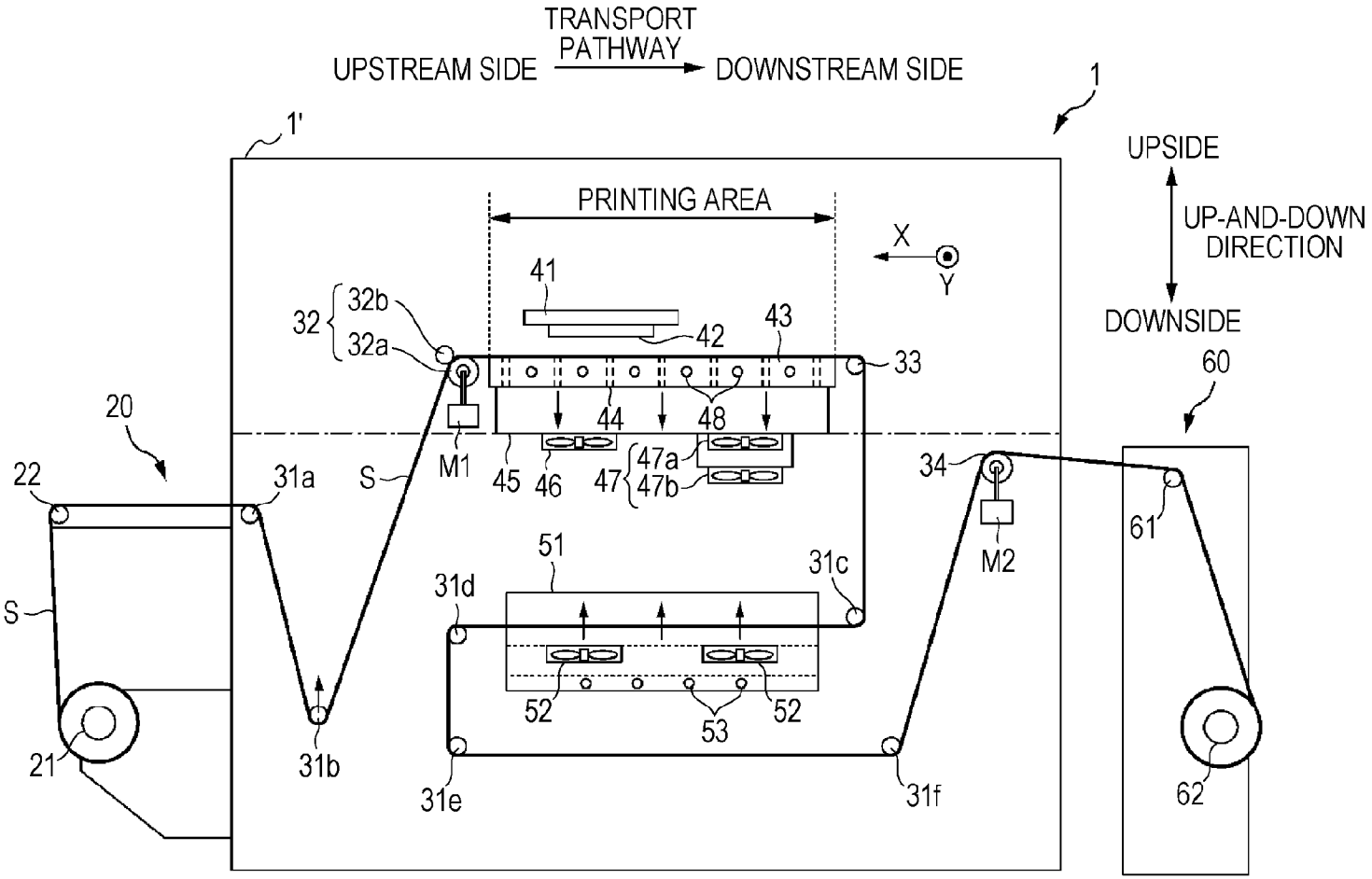
FIG. 2 is a cross-sectional view showing the outline of the printer.

FIG. 1 is a block diagram of the overall configuration of a printer 1. FIG. 2 is a cross-sectional view showing the outline of the printer 1. The printer 1 of this embodiment prints an image on rolled paper S (continuous paper) as a medium. Further, the printer 1 is connected to a computer 2 so as to be able to communicate therewith, and the computer 2 creates printing data for making the printer 1 print an image. In addition, the function of the computer 2 may also be built in the printer 1.

A controller 10 (equivalent to a control section) is a control unit for performing control of the printer 1. An interface section 11 is for performing transmission and reception of data between the computer 2 and the printer 1. A CPU 12 is an arithmetic processing unit for performing control of the entire printer 1. A memory 13 is for securing an area which stores a program of the CPU 12, a working area, or the like. The CPU 12 controls each unit in accordance with a unit control circuit 14. In addition, a detector group 70 monitors the circumstances of the inside of the printer 1 and the controller 10 controls each unit on the basis of the detection result.

A feed unit 20 is for feeding the rolled paper S to a transport unit 30. The feed unit 20 includes a winding shaft 21 on which the rolled paper S is wound and which is rotatably supported, and a relay roller 22 for making the rolled paper S unwound from the winding shaft 21 be wound around it and led to the transport unit 30. In addition, the feed unit 20 is located outside a main body portion 1' of the printer 1.

The transport unit 30 (equivalent to a transport section) is for transporting the rolled paper S sent from the feed unit 20 from the upstream side to the downstream side along a preset transport pathway by a plurality of transport rollers. The transport unit 30 includes a plurality of relay rollers 31*a* to 31*f*, a supply roller 32, a discharge roller 33, and a transport driving roller 34. The rolled paper S moves sequentially via these rollers, whereby the transport pathway for transporting the rolled paper S is formed.

The supply roller 32 is provided at a position immediately on the upstream side of a printing area and is constituted by paired rollers 32*a* and 32*b*. The rolled paper S is nipped by the two rollers 32*a* and 32*b*. Then, the roller on one side is a supply driving roller 32*a* which is rotated by a first motor M1, and the roller on the other side is a supply driven roller 32*b* which is rotated in conjunction with the supply driving roller 32*a*.

Further, the transport driving roller 34 is provided at a position further on the downstream side of the transport pathway than the printing area and further on the downstream side of the transport pathway than a drying furnace 51 (described later). Then, the transport driving roller 34 is a driving roller which is rotated by a second motor M2 (equivalent to a motor included in the transport section).

The controller 10 prints an image on the rolled paper S which is located at the printing area, then discharges the site of the rolled paper S on which the image is printed, from the printing area, and supplies the site of the rolled paper S on which the image is not yet printed, to the printing area. That is, the controller 10 repeatedly carries out a printing operation and a transport operation of the rolled paper S alternately.

Further, the controller 10 performs position control of the first motor M1 and torque control of the second motor M2. Then, at the time of the transport operation, the controller 10 performs control such that the first motor M1 rotates by a given rotational amount, and performs control such that a given torque is generated at the second motor M2. Therefore, at the time of the transport operation, the transport driving roller 34 is rotated by the torque which is generated at the second motor M2 and tension which tries to transport the rolled paper S to the downstream side of the transport pathway is imparted to the rolled paper S. Further, at the same time, the supply roller 32 is also rotated by the first motor M1.

As a result, at the time of the transport operation, the rolled paper S is transported to the downstream side of the transport pathway.

In addition, the rotational amount by which the first motor M1 rotates at the time of the transport operation corresponds to the length of the rolled paper S which is transported by a single transport operation. Further, the torque which is generated at the second motor M2 at the time of the transport operation is set such that tension in which the rolled paper S does not flutter at the time of the transport operation is imparted to the rolled paper S.

Further, there is a case where, at the time of the transport operation, the feeding of the rolled paper S from the feed unit 20 (the winding shaft 21) does not follow. Therefore, the rolled paper S corresponding to an amount which is transported by a single transport operation is wound around the relay rollers 31*a* and 31*b* which are located between the feed unit 20 and the printing area, thereby being slackened. Then, the relay roller 31*b* which is located at the lower side of the printer 1 is made to be movable in the up-and-down direction. In this way, in a case where at the time of the transport operation, feeding of the rolled paper S from the feed unit 20 is late, the relay roller 31*b* is lifted up, so that the slackened rolled paper S is supplied to the printing area. As a result, the rolled paper S of a given length can be supplied to the printing area at a given transport time.

A recording unit 40 (equivalent to a recording section) is for printing (recording) an image on the rolled paper S which is located at the printing area. The recording unit 40 includes a carriage 41 and a head 42. The carriage 41 moves the head 42 in an X direction (a direction in which the rolled paper S is transported) and a Y direction (the width direction of the rolled paper S) while being guided by a guide shaft (not shown). The head 42 is for discharging ink onto the rolled paper S and a plurality of nozzles which are ink discharging portions are provided at the lower surface of the head 42. The head 42 discharges ink while moving in the X direction and the Y direction along with the carriage 41, whereby a two-dimensional image is printed on the rolled paper S.

In addition, an ink discharging system from the nozzle may be a piezo system of discharging ink by expanding or contracting a pressure chamber by applying voltage to a driving element (a piezoelectric element) or may also be a thermal system in which an air bubble is generated in a nozzle by using a heater element and ink is discharged by the air bubble.

Further, the rolled paper S which is located at the printing area is supported on the upper surface of a platen 43 from the rear surface side which is the opposite side to a printing surface. A negative pressure chamber 45 is connected to the bottom of the platen 43 and a first fan mechanism 46 and a second fan mechanism 47 are mounted in parallel on the bottom of the negative pressure chamber 45. In addition, the second fan mechanism 47 is constituted by two fans 47*a* and 47*b*, and on the lower side of the one fan 47*a*, the other fan 47*b* is mounted. Further, in the platen 43, a suction hole 44 which penetrates the platen 43 in the up-and-down direction is provided, and the negative pressure chamber 45 communicates with the outside (a portion above the platen 43) through the suction hole 44. That is, the platen 43 supports the rolled paper S which is located at the printing area, at a support surface (top surface) in which an opening portion of the suction hole 44 is provided.

The first fan mechanism 46 and the second fan mechanism 47 discharge air in the negative pressure chamber 45 to the outside, thereby making the inside of the negative pressure chamber 45 have a negative pressure state. At that time, external air above the support surface of the platen 43 is suctioned into the negative pressure chamber 45 through the suction hole 44, so that the rolled paper S on the platen 43 is suctioned and stuck to the support surface of the platen 43. That is, the rolled paper S on the platen 43 is suctioned through the suction hole 44 by the negative pressure chamber 45, the first fan mechanism 46, and the second fan mechanism 47, so that the rolled paper S on the platen 43 is held at a given position. Hereinafter, the negative pressure chamber 45, the first fan mechanism 46, and the second fan mechanism 47 are collectively called a "suction section".

Further, a plurality of heaters 48 (for example, nichrome wires) is disposed inside the platen 43. The heaters 48 are energized, whereby the temperature of the platen 43 rises and the temperature of the rolled paper S on the platen 43 also rises. In addition, the heaters 48 are disposed over the entire area of the platen 43 such that heat is evenly transmitted to the rolled paper S on the platen 43. As a result, it is possible to promote drying of ink landed on the rolled paper S on the platen 43, so that blurring of ink in a printed image can be suppressed.

A drying unit 50 (equivalent to a heating section) includes the drying furnace 51 for fixing an image printed on the rolled paper S. The drying furnace 51 is located further on the downstream side of the transport pathway than the printing area, but further on the upstream side of the transport pathway than the transport driving roller 34 which is rotated by the second motor M2. Further, the drying furnace 51 includes a plurality of fans 52 and a plurality of heaters 53. In the drying furnace 51, air heated by the heaters 53 is blown to the printing surface of the rolled paper S supplied into the drying furnace 51, by the fans 52. As a result, ink constituting an image printed on the rolled paper S can be dried, so that the image printed on the rolled paper S can be fixed to the rolled paper S. For this reason, even if the printed rolled paper S is wound in a roll form, the rear surface of the rolled paper S is prevented from being stained by ink, so that high-quality printed matter can be provided. In addition, the configuration of the drying furnace 51 is not limited thereto and a configuration is also acceptable in which convection of high-temperature air blown to the rolled paper S occurs within the drying furnace 51 or a configuration is also acceptable in which only heating of air in the drying furnace 51 by the heaters 53 is performed.

A take-up unit 60 is for taking up the rolled paper S (the printed rolled paper S) sent by the transport unit 30. The take-up unit 60 includes a relay roller 61 which winds and transports the rolled paper S sent from the transport driving roller 34, and a take-up driving shaft 62 which takes up the rolled paper S. In addition, the take-up unit 60 is located outside the main body portion 1' of the printer 1.

High-Suction Mode and Low-Suction Mode

As described above, in the printer 1 of this embodiment, the rolled paper S supported on the platen 43 is suctioned and stuck to the support surface of the platen 43 through the suction hole 44 by the suction section (the negative pressure chamber 45, the first fan mechanism 46, and the second fan mechanism 47).

During the printing operation, suction sticking power supplied to the rolled paper S on the platen 43 is required to be as strong as possible such that the rolled paper S on the platen 43 is held at a given position and such that even if the rolled paper S is swollen by moisture of ink, the rolled paper S is held in a flat state. The rolled paper S during the printing operation is held in a flat state, whereby heat of the heaters 48 in the platen 43 is easily transmitted to the rolled paper S on the platen 43, so that blurring of ink can be suppressed. Further, it is possible to make an ink droplet land at a correct position on the rolled paper S or prevent contact of the rolled paper S with the head 42.

On the other hand, during the transport operation, the suction sticking power supplied to the rolled paper S on the platen 43 is required to be set to be as weak as possible to an extent that the rolled paper S does not flutter, such that great resistance to transport is avoided.

That is, during the transport operation, the suction power of the suction section supplied to the rolled paper S on the platen 43 is required to be set to be weak compared to that during the printing operation. Therefore, in the printer 1 of this embodiment, a "high-suction mode" for making the suction power of the suction section supplied to the rolled paper S high (equivalent to a first suction power) and a "low-suction mode" for making the suction power of the suction section supplied to the rolled paper S low (equivalent to a second suction power) are provided. Then, the controller 10 allows the high-suction mode and the low-suction mode to be switched.

The controller 10 performs setting so as to be the high-suction mode during the printing operation and to be the low-suction mode during the transport operation. In this way, during the printing operation, it is possible to hold the rolled paper S on the platen 43 in a flat state at a given position, and during the transport operation, it is possible to smoothly transport the rolled paper S. In other words, by selecting the low-suction mode during the transport operation, even if a transport force supplied to the rolled paper S by the transport unit 30 is weak (specifically, even if the torque value of the second motor M2 is low), the rolled paper S can be transported. Accordingly, it is possible to reduce costs or attain power saving.

In order to change the suction power supplied to the rolled paper S on the platen 43, it is only necessary to change the negative pressure in the negative pressure chamber 45. By increasing the negative pressure in the negative pressure chamber 45 (by lowering pressure), it is possible to increase the suction power supplied to the rolled paper S on the platen 43, and by lowering the negative pressure in the negative pressure chamber 45 (by increasing pressure), it is possible to lower the suction power supplied to the rolled paper S on the platen 43.

In addition, it is acceptable if the pressure (negative pressure) in the negative pressure chamber 45 is set depending on a transport force supplied to the rolled paper S by the transport unit 30, the type of the rolled paper S, or the like, and for example, in the high-suction mode, the pressure in the negative pressure chamber 45 is set to be a pressure 805 Pa lower than atmospheric pressure, and in the low-suction mode, the pressure in the negative pressure chamber 45 is set to be pressure 140 Pa lower than atmospheric pressure. Further, a configuration may also be made such that a pressure sensor (not shown) which detects the pressure in the negative pressure chamber 45 is provided at the negative pressure chamber 45, thereby confirming whether or not the pressure in the negative pressure chamber 45 is desired pressure (negative pressure).

In the printer 1 of this embodiment, in order to change the pressure in the negative pressure chamber 45 in accordance with the mode, during the time of operation of the high-suction mode, both the first fan mechanism 46 and the second fan mechanism 47 are set to be in an ON state, and during the time of operation of the low-suction mode, the first fan mechanism 46 is set to be in an ON state and the second fan mechanism 47 is set to be in an OFF state.

This is because it is possible to improve static pressure in a configuration in which two fans 47*a* and 47*b* are disposed in series as in the second fan mechanism 47 (a configuration in which the shafts of the fans are disposed so as to be located on the same axis), rather than a single fan (the first fan mechanism 46) having the same characteristic. That is, it is possible to increase the negative pressure in the negative pressure chamber 45 when the second fan mechanism 47 with two fans disposed in series discharges air in the negative pressure chamber 45, rather than when the first fan mechanism 46 which is constituted by a single fan discharges air in the negative pressure chamber 45.

Further, at the time of the low-suction mode, since the second fan mechanism 47 enters an OFF state, while air in the negative pressure chamber 45 is discharged to the outside by the first fan mechanism 46, the inside of the negative pressure chamber 45 is opened to the air by the second fan mechanism 47. For this reason, the negative pressure in the negative pressure chamber 45 is immediately lowered (pressure rises), so that switching from the high-suction mode to the low-suction mode can be promptly performed.

In addition, in order to change the negative pressure in the negative pressure chamber 45, there is no limitation to a configuration in which the first fan mechanism 46 which is constituted by a single fan and the second fan mechanism 47 in which two fans 47*a* and 47*b* are disposed in series are disposed in parallel. For example, it is also possible to change the negative pressure in the negative pressure chamber 45 by changing the rotation frequency of the fan.

Print Processing

Print Processing of Comparative Example

Figure 3A:
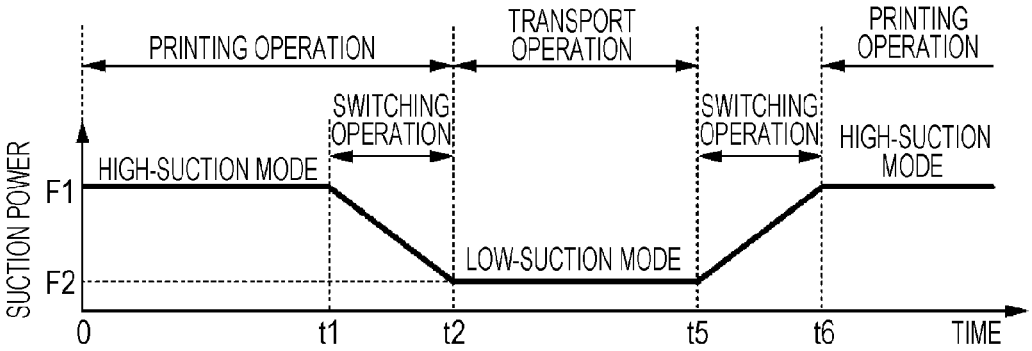
FIGS. 3A to 3C are diagrams describing print processing of a comparative example.
Figure 3B:
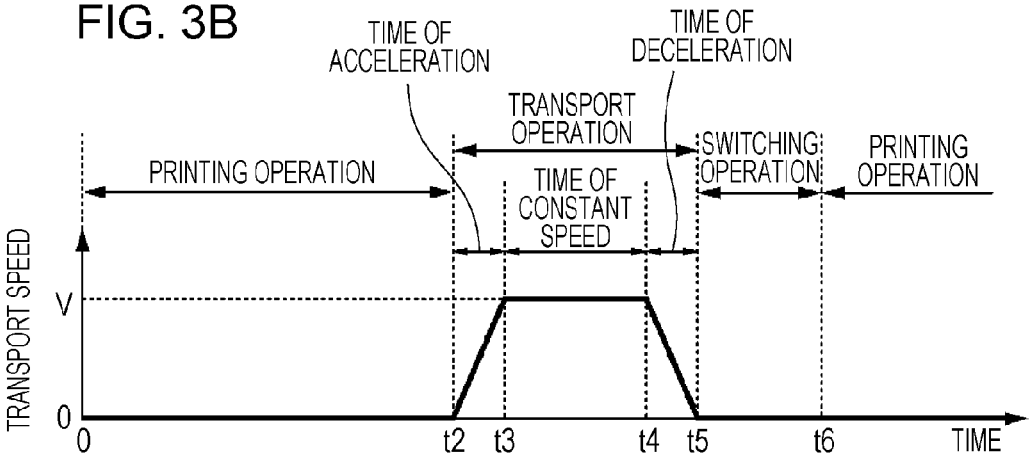
Figure 3C:
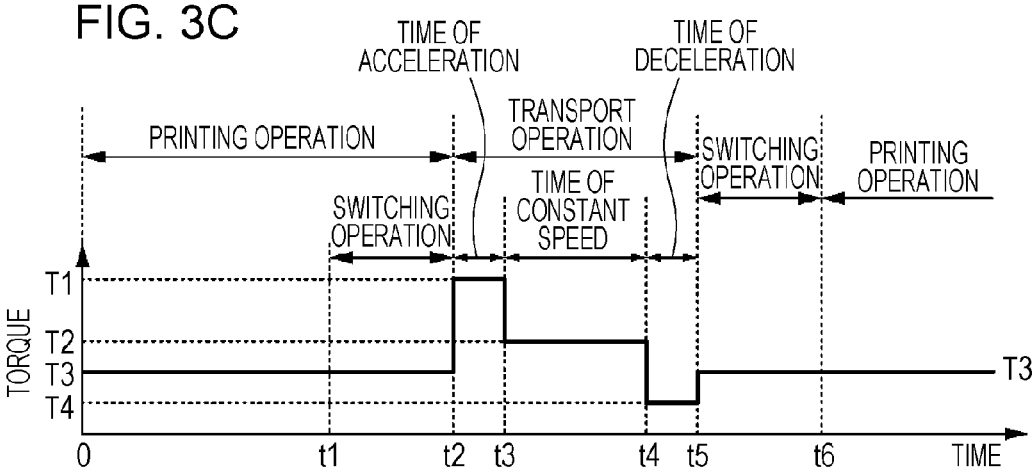
Figure 4:
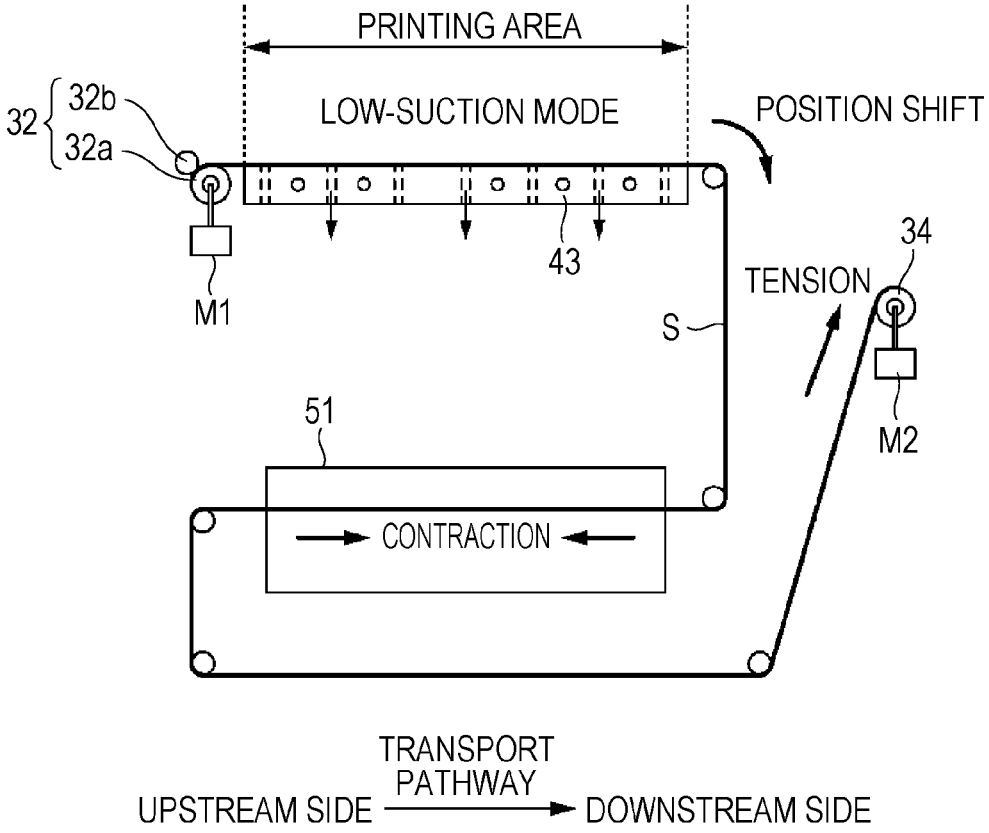
FIG. 4 is a diagram describing shifting of rolled paper in the print processing of the comparative example.

FIGS. 3A to 3C are diagrams describing print processing of a comparative example, and FIG. 4 is a diagram describing the shift of the rolled paper S in the print processing of the comparative example. FIG. 3A is a graph showing the relationship between the suction power of the suction section supplied to the rolled paper S on the platen 43 and time, FIG. 3B is a graph showing the relationship between the transport speed of the rolled paper S and time, and FIG. 3C is a graph showing the relationship between the torque which is generated at the second motor M2 which rotates the transport driving roller 34 and time. The printing operation is set to be performed at a "time from 0 to t2" and the transport operation is set to be performed at a "time from t2 to t5".

As described above, at the time of the printing operation, it is preferable to make the suction power of the suction section supplied to the rolled paper S on the platen 43 strong, and at the time of the transport operation, it is preferable to make the suction power of the suction section supplied to the rolled paper S on the platen 43 weak. However, if the high-suction mode is maintained throughout the printing operation and switching from the high-suction mode to the low-suction mode is performed after the end of the printing operation, it is not possible to make the transition to the transport operation directly after the end of the printing operation. That is, a switching operation from the high-suction mode to the low-suction mode is needed between the printing operation and the transport operation, so that the overall operational time is lengthened.

Therefore, in the comparative example, the switching from the high-suction mode to the low-suction mode is performed during the printing operation. Here, the controller 10 performs the switching from the high-suction mode to the low-suction mode at a "time t1" which is during the printing operation. In this way, since the switching operation from the high-suction mode to the low-suction mode is performed in parallel with the printing operation, it is possible to shorten the overall operational time. In addition, after the end of the transport operation, the switching operation from the low-suction mode to the high-suction mode is performed and thereafter, the printing operation is started again.

Then, the period (from t2 to t5) of the transport operation is divided into three periods, the time (from t2 to t3) of acceleration when the rolled paper S starts to move, the time (from t3 to t4) of constant speed when the rolled paper S is transported at a constant speed V, and the time (from t4 to t5) of deceleration before the rolled paper S is stopped, as shown in FIG. 3B. In addition, at the times other than the time of the transport operation, the transport speed of the rolled paper S is 0.

The controller 10 controls the torque which is generated at the second motor M2 and imparts tension for transporting the rolled paper S to the rolled paper S through the transport driving roller 34 which is rotated by the second motor M2. Accordingly, the controller 10 controls the torque of the second motor M2 such that the rolled paper S is transported at the transport speed shown in FIG. 3B.

Specifically, the controller 10 controls the torque of the second motor M2 such that the highest torque T1 is generated at the second motor M2 at the time (from t2 to t3) of acceleration, a torque T2 lower than the torque T1 at the time of acceleration is generated at the second motor M2 at the time (from t3 to t4) of constant speed, and the lowest torque T4 is generated at the second motor M2 at the time (from t4 to t5) of deceleration, as shown in FIG. 3C. In addition, the controller 10 controls the torque which is generated at the second motor M2, by controlling a current value which flows to the second motor M2.

Then, in the comparative example, also at the times (0 to t2, and t5 or later) other than the time of the transport operation, relatively high tension is imparted to the rolled paper S. For this reason, the controller 10 performs control such that at the times other than the time of the transport operation, a torque T3 higher than the torque T4 at the time of deceleration is generated at the second motor M2.

On the other hand, the first motor M1 which rotates the supply roller 32 on the upstream side of the printing area is subjected to position control, and after the end of the transport operation, the site of the rolled paper S nipped by the supply roller 32 is controlled so as to remain at the position.

Accordingly, also at the times other than the time of the transport operation, the rolled paper S between the supply roller 32 and the transport driving roller 34 enters a tense state without being slackened. Therefore, contact of the rolled paper S with the fans 52 in the drying furnace 51 is prevented or the next transport operation can be smoothly performed.

In the printer 1, as shown in FIG. 4, the drying furnace 51 is provided at a position further on the downstream side of the transport pathway than the printing area, but further on the upstream side of the transport pathway than the transport driving roller 34 which is rotated by the second motor M2. The inside of the drying furnace 51 has a high temperature (for example, 75 degrees) in order to fix an image printed on the rolled paper S. For this reason, the site of the rolled paper S which is located in the drying furnace 51 contracts toward the central portion of the drying furnace 51 along with evaporation of moisture or ink in the rolled paper S.

In this comparative example, also at the times other than the time of the transport operation, relatively high tension is imparted to the rolled paper S. However, at the time of the high-suction mode, suction power F1 of the suction section, that is, the force of holding the rolled paper S on the platen 43 at the position is strong. Accordingly, at the time of the high-suction mode, the force of holding the rolled paper S on the platen 43 at the position becomes stronger than the tension (the force of pulling the rolled paper S to the downstream side of the transport pathway) which is imparted to the rolled paper S by the second motor M2. Therefore, if the rolled paper S in the drying furnace 51 contracts at the time of the high-suction mode, the rolled paper S on the transport driving roller 34 side (the rolled paper S further on the downstream side of the transport pathway than the drying furnace 51) is pulled to the drying furnace 51 side.

On the other hand, when the suction power of the suction section is a suction power lower than the suction power F1 at the time of the high-suction mode (that is, at the time of the switching operation or the time of the low-suction mode), the force of holding the rolled paper S on the platen 43 at the position becomes weaker than the tension which is imparted to the rolled paper S by the second motor M2. Therefore, if the rolled paper S in the drying furnace 51 contracts at the time of the switching operation or the time of the low-suction mode, as shown in FIG. 4, the rolled paper S on the platen 43 side (the rolled paper S further on the upstream side of the transport pathway than the drying furnace 51) is pulled to the drying furnace 51 side.

In this comparative example, in order to shorten the overall operational time, the switching from the high-suction mode to the low-suction mode is performed during the printing operation. For this reason, if the rolled paper S in the drying furnace 51 contracts after the switching from the high-suction mode to the low-suction mode (in FIGS. 3A to 3C, at the time of the switching operation: a time from t1 to t2), despite the printing operation being performed, the rolled paper S on the platen 43 is pulled to the drying furnace 51 side (the downstream side of the transport pathway), so that the printing position of an image is shifted. Specifically, the position of an image which is printed after the switching from the high-suction mode to the low-suction mode is shifted to the upstream side of the transport pathway with respect to the position of an image printed at the time of the high-suction mode. As a result, the image quality of the printed image deteriorates.

Therefore, this embodiment aims to suppress deterioration in the image quality of the printed image.

Print Processing of this Embodiment

Figure 5A:
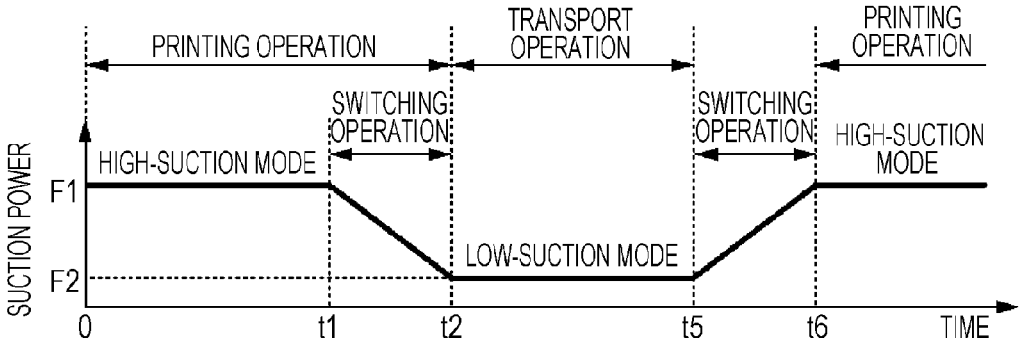
FIGS. 5A to 5C are diagrams describing print processing of an embodiment.
Figure 5B:
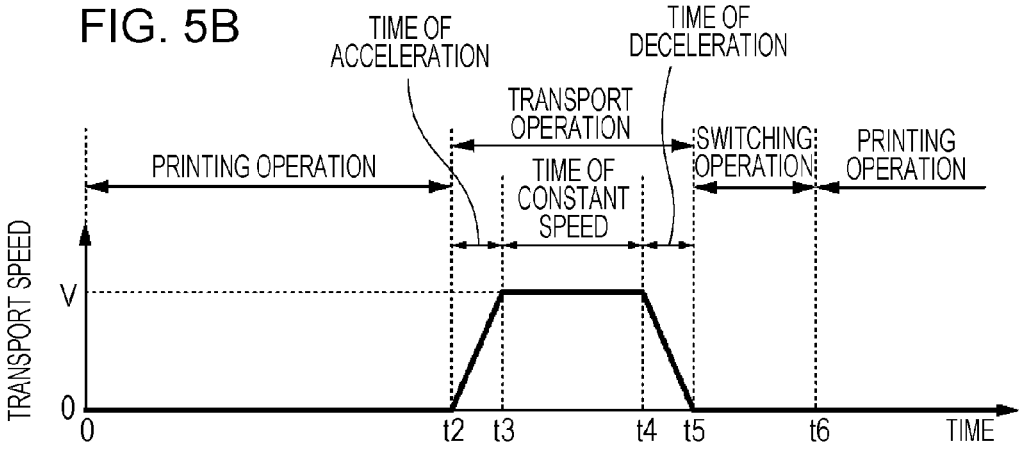
Figure 5C:
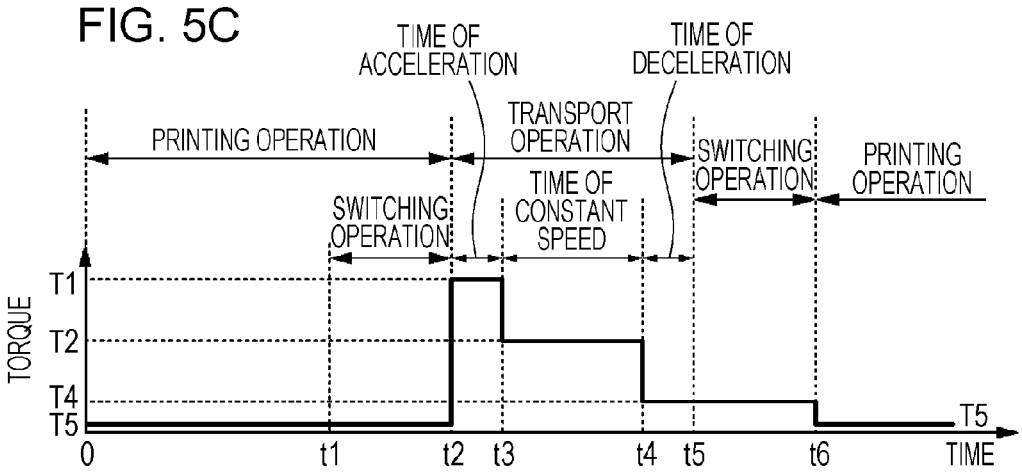

FIGS. 5A to 5C are diagrams describing print processing of this embodiment. FIG. 5A is a graph showing the relationship between the suction power of the suction section supplied to the rolled paper S on the platen 43 and time, FIG. 5B is a graph showing the relationship between the transport speed of the rolled paper S and time, and FIG. 5C is a graph showing the relationship between the torque which is generated at the second motor M2 which rotates the transport driving roller 34 and time. In addition, the printing operation is set to be performed at a "time from 0 to t2" and the transport operation is set to be performed at a "time from t2 to t5".

Also in this embodiment, similarly to the comparative example, in order to shorten the overall operational time, the switching from the high-suction mode to the low-suction mode is performed during the printing operation (at the time t1). That is, the controller 10 lowers the suction power of the suction section supplied to the rolled paper S from the high suction power F1 (equivalent to the first suction power) to low suction power F2 (equivalent to the second suction power) during the printing operation.

However, during the printing operation of the comparative example (FIG. 3C), the torque T3 which is generated at the second motor M2 is set to be a torque higher than the torque T4 at the time of deceleration (the time of the transport operation), whereas during the printing operation of this embodiment (FIG. 5C), a torque T5 which is generated at the second motor M2 is set to be a torque lower than the torque T4 at the time of deceleration. Hereinafter, the torque T5 lower than the torque T4 at the time of deceleration is also referred to as a "minute torque T5".

More specifically, in the printer 1 of this embodiment, the drying furnace 51 is provided at a position which is further on the downstream side of the transport pathway than the printing area, but further on the upstream side of the transport pathway than the transport driving roller 34 which is rotated by the second motor M2, and the controller 10 performs the switching from the high-suction mode to the low-suction mode during the printing operation and makes the torque T5 (equivalent to the first torque) which is generated at the second motor M2 in a period which is during the printing operation and in which the suction power of the suction section is a suction power lower than the suction power F1 at the time of the high-suction mode, be lower than the torque T1, T2, and T4 (equivalent to the second torque) which is generated at the second motor M2 during the transport operation.

Accordingly, in this embodiment, the minute torque T5 which is generated at the second motor M2 in the period which is during the printing operation and in which the suction power of the suction section is a suction power lower than the suction power F1 at the time of the high-suction mode can be made lower as the force of holding the rolled paper S on the platen 43 at the position becomes stronger than the tension which is imparted to the rolled paper S by the minute torque T5.

For this reason, in this embodiment, even if the rolled paper S in the drying furnace 51 contracts after the switching from the high-suction mode to the low-suction mode is performed during the printing operation, so that the suction power of the suction section becomes weaker than the suction power F1 at the time of the high-suction mode, the rolled paper S on the transport driving roller 34 side (the rolled paper S further on the downstream side of the transport pathway than the drying furnace 51) is pulled to the drying furnace 51 side, similarly to the time of the high-suction mode. That is, in this embodiment, even if the switching from the high-suction mode to the low-suction mode is performed during the printing operation, the shifting of the position of the rolled paper S on the platen 43 during the printing operation can be prevented, so that the shift of the printing position of an image can be prevented. That is, in this embodiment, it is possible to suppress deterioration in the image quality of a printed image while shortening the overall operational time.

In addition, with respect to the period which is during the printing operation and in which the suction power of the suction section is a suction power lower than the suction power F1 at the time of the high-suction mode, in FIGS. 5A to 5C, the period (a time from t1 to t2) of the switching operation corresponds thereto.

Further, in this embodiment, also in the period (from t1 to t2) which is during the printing operation and in which the suction power of the suction section is a suction power lower than the suction power F1 at the time of the high-suction mode, although it is minute, the torque T5 is generated at the second motor M2. If a torque is absolutely not generated at the second motor M2 in this period (from t1 to t2) (that is, if the torque of the second motor M2 is set to be 0), the rolled paper S between the transport driving roller 34 and the printing area becomes slack. Then, the rolled paper S comes into contact with the fans 52 in the drying furnace 51 or it does not become possible to smoothly perform the next transport operation.

On the other hand, as in the comparative example (FIGS. 3A to 3C), if excessive torque (that is, the torque T3 larger than the torque T4 at the time of deceleration) is generated at the second motor M2 in this period (from t1 to t2), the position of the rolled paper S on the platen 43 side is shifted due to extension and contraction of the rolled paper S in the drying furnace 51. Then, the printing position of an image is shifted, so that the image quality of a printed image deteriorates.

Therefore, as in this embodiment, in the period (from t1 to t2) which is during the printing operation and in which the suction power of the suction section is a suction power lower than the suction power F1 at the time of the high-suction mode, it is preferable if the minute torque T5 is generated at the second motor M2. In this way, it is possible to prevent the shift of the printing position of an image while preventing the slackening of the rolled paper S between the transport driving roller 34 and the printing area.

That is, in this embodiment, when the rolled paper S has extended and contracted in the drying furnace 51 in the period (from t1 to t2) which is during the printing operation and in which the suction power of the suction section is a suction power lower than the suction power F1 at the time of the high-suction mode, the minute torque T5 of an extent that the second motor M2 rotates in the opposite direction to that at the time of the transport operation is generated at the second motor M2. In other words, the torque T5 which is generated at the second motor M2 is set to be minute such that the tension which is imparted to the rolled paper S by the minute torque T5 becomes overwhelmingly weaker than the force of making the rolled paper S on the platen 43 be held at the position.

For example, in this period (from t1 to t2), in the comparative example, a torque of 33 N is generated at the second motor M2, whereas in this embodiment, it is acceptable if it is made such that a torque of 1 N or less (however, 0 N is not included) is generated at the second motor M2. In addition, the controller 10 controls the torque which is generated at the second motor M2, by controlling a current value which flows to the second motor M2. Therefore, in this period (from t1 to t2), for example, in the comparative example, an electric current of 1 A flows to the second motor M2, whereas in this embodiment, it is acceptable if it is made such that an electric current of 0.27 A flows to the second motor M2.

Further, if it is the time of the high-suction mode (the time from 0 to t1) even during the printing operation, even if the torque which is generated at the second motor M2 is set to be a torque larger than the minute torque T5, there is no concern that the rolled paper S on the platen 43 side may be shifted due to extension and contraction of the rolled paper S in the drying furnace 51. However, the first motor M1 is subjected to position control. For this reason, after the end of the transport operation, the force of making the first motor M1 remain at the position (that is, the force of making the rolled paper S nipped by the supply roller 32 remain at the position) and the tension which is imparted to the rolled paper S by the second motor M2 is stable in a balanced state.

If the torque value of the second motor M2 is varied in the balanced state, there is a case where the balance between the force of making the rolled paper S nipped by the supply roller 32 remain at the position and the tension which is imparted to the rolled paper S by the second motor M2 is lost from the moment at which the torque value varies. There is concern that at the moment the balance is lost, the rolled paper S on the platen 43 may be shifted to the upstream side of the transport pathway (to the first motor M1 side). For this reason, if the torque of the second motor M2 is lowered from, for example, the torque T4 at the time of deceleration to the minute torque T5 during the printing operation, there is concern that the printing position of an image may be shifted.

Therefore, in this embodiment, after the end of the transport operation and before the start of the printing operation (between t5 and t6 in FIGS. 5A to 5C), the torque which is generated at the second motor M2 is changed into the minute torque T5. That is, after the end of the transport operation and before the start of the printing operation, the controller 10 lowers the torque which is generated at the second motor M2 from the torque T4 at the time of deceleration (the torque at the time of the transport operation) to the minute torque T5. Here, as shown in FIG. 5C, immediately before the start of the printing operation (at a time t6), the torque which is generated at the second motor M2 is lowered from the torque T4 at the time of deceleration to the minute torque T5.

In this way, since during the printing operation, the torque of the second motor M2 does not vary, the balance between the force of making the rolled paper S nipped by the supply roller 32 remain at the position and the tension which is imparted to the rolled paper S by the second motor M2 can be prevented from being lost. Therefore, a situation can be prevented in which during the printing operation, the position of the rolled paper S on the platen 43 is shifted, so that the printing position of an image is shifted.

Further, in this embodiment, after the end of the transport operation, the switching operation from the low-suction mode to the high-suction mode is performed (the suction power of the suction section is raised from the second suction power to the first suction power), and after the suction power of the suction section reaches the suction power F1 at the time of the high-suction mode, the torque which is generated at the second motor M2 is changed into the minute torque T5. That is, after the suction power of the suction section reaches the suction power F1 at the time of the high-suction mode, the controller 10 lowers the torque which is generated at the second motor M2 from the torque T4 at the time of deceleration (the torque at the time of the transport operation) to the minute torque T5. Here, as shown in FIG. 5C, immediately after the end of the switching operation (at a time t6), the torque which is generated at the second motor M2 is lowered from the torque T4 at the time of deceleration to the minute torque T5.

In this way, in a state where a torque (here, the torque T4 at the time of deceleration) larger than the minute torque T5 is generated at the second motor M2, the switching from the low-suction mode to the high-suction mode can be performed. That is, in a state where relatively large tension is imparted to the rolled paper S, the switching from the low-suction mode to the high-suction mode is performed. For this reason, it is possible to suction and stick the rolled paper S to the support surface of the platen 43 in a state where the rolled paper S has been tense without being slackened. As a result, it is possible to suction and stick a given site of the rolled paper S to the support surface of the platen 43 in a flat state.

In addition, in this embodiment, in order to shorten the overall operational time, the switching from the high-suction mode to the low-suction mode is performed during the printing operation. However, it is preferable to perform the switching operation from the high-suction mode to the low-suction mode during the latter half of the printing operation. Moreover, it is preferable to start the switching operation from the high-suction mode to the low-suction mode at the point of time (the time t1) when a time required for the switching operation is calculated back from the point of time (the time t2) of the end of the printing operation. In this way, it is possible to lengthen a time during which the high-suction mode operates during the printing operation as much as possible. As a result, it is possible to hold the rolled paper S on the platen 43 at a given position in a flat state over a longer time during the printing operation.

MODIFIED EXAMPLE

Figure 6A:
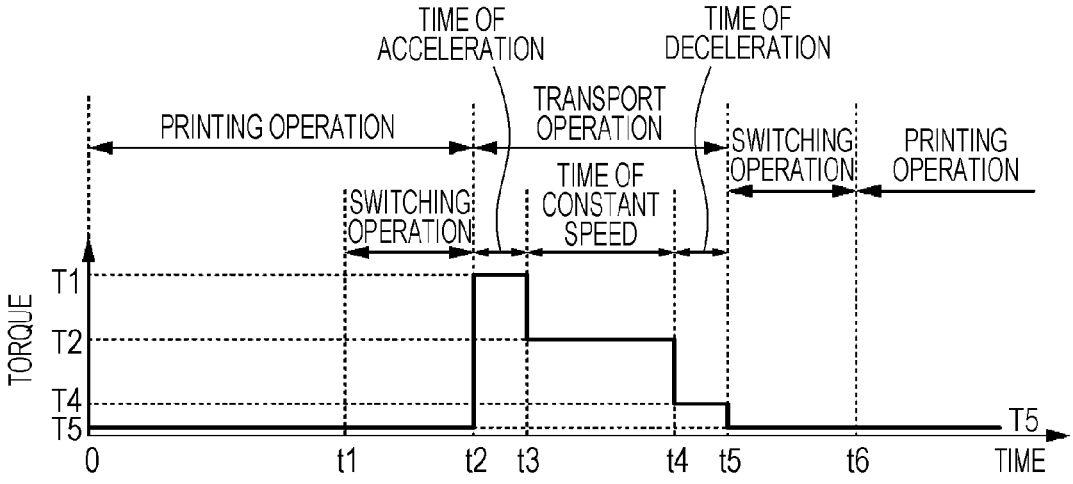
FIGS. 6A and 6B are diagrams describing print processing of modified examples.
Figure 6B:
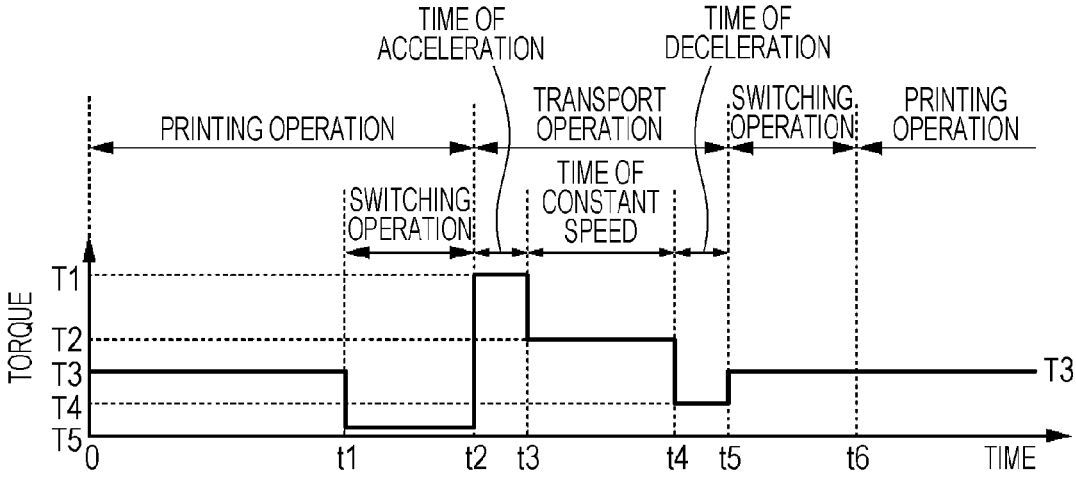

FIGS. 6A and 6B are diagrams describing print processing of modified examples. In the above-described embodiment (FIGS. 5A to 5C), at the "time t6" that is immediately after the end of the switching operation and immediately before the start of the printing operation, the torque which is generated at the second motor M2 is lowered from the torque T4 at the time of deceleration to the minute torque T5. However, there is no limitation thereto.

For example, as shown in FIG. 6A, the torque which is generated at the second motor M2 may also be lowered from the torque T4 at the time of deceleration to the minute torque T5 at the "time t5" that is immediately after the end of the transport operation. In this case, even if the rolled paper S extends and contracts in the drying furnace 51 in the period (the time of the switching operation in FIG. 6A, from t1 to t2) which is during the printing operation and in which the suction power of the suction section is a suction power lower than the suction power F1 at the time of the high-suction mode, the shifting of the position of the rolled paper S on the platen 43 can be prevented, so that it is possible to suppress deterioration in the image quality of a printed image.

Further, for example, as shown in FIG. 6B, the torque which is generated at the second motor M2 may also be set to be a torque higher than the minute torque T5 (for example, to be the torque T4 at the time of deceleration or the torque T3 higher than the torque T4 at the time of deceleration) in the period after the end of the transport operation and before the start of the switching operation in the printing operation. Then, the torque which is generated at the second motor M2 may also be changed into the minute torque T5 before the start of the switching operation in the printing operation.

In this case, even if the rolled paper S extends and contacts in the drying furnace 51 in the period (the time of the switching operation in FIG. 6B, from t1 to t2) which is during the printing operation and in which the suction power of the suction section is a suction power lower than the suction power F1 at the time of the high-suction mode, the shifting of the position of the rolled paper S on the platen 43 can be prevented, so that it is possible to suppress deterioration in the image quality of a printed image.

However, if the torque which is generated at the second motor M2 is changed during the printing operation, the balance between the force of making the rolled paper S nipped by the supply roller 32 remain at the position and the tension which is imparted to the rolled paper S by the second motor M2 is lost, so that there is concern that the printing position of an image may be shifted. Therefore, as in the above-described embodiment, it is preferable to change the torque which is generated at the second motor M2 into the minute torque T5 before the start of the printing operation.

Other Embodiments

This embodiment mainly describes the image recording apparatus. However, disclosure of an image recording method or the like is also included therein. Further, this embodiment is for facilitating understanding of the invention and should not be construed as limiting the invention thereto. The invention can be modified and improved without departing from the purpose thereof and it goes without saying that the equivalents thereto are included in the invention. In particular, embodiments which are described below are also included in the invention.

Printer

In the above-described embodiments, the printer 1 which prints an image while moving the head 42 in the X direction and the Y direction with respect to the rolled paper S which is located at the printing area is taken as an example. However, it is not limited thereto. For example, a printer is also acceptable which prints an image when the rolled paper S passes below a fixed head.

Further, the medium on which an image is recorded is not limited to the rolled paper and may also be single sheet paper, and an image recording apparatus which records an image on a medium by discharging other fluids other than ink from a nozzle is also acceptable.

Further, the image recording apparatus is not limited to the printer and the same technique as the above-described embodiment may also be applied to various apparatuses in which an ink jet technique is applied, such as a color filter manufacturing apparatus, a dyeing apparatus, a micro-fabrication apparatus, a semiconductor manufacturing apparatus, a surface fabrication apparatus, a three-dimensional modeling device, a gas vaporizer, an organic EL manufacturing apparatus (especially, a polymer EL manufacturing apparatus), a display manufacturing apparatus, a film formation apparatus, and a DNA chip manufacturing apparatus, for example.

What is claimed is:

1. An image recording apparatus comprising:

a medium support section supporting a medium at a support surface provided a suction hole;

a recording section which records an image on the medium supported on the medium support section;

a suction section which suctions the medium supported on the medium support section through the suction hole;

a transport section which transports the medium;

a control section which:

controls the recording section, the suction section and the transport section, controls the recording section and the transport section to repeatedly carry out the transportation operation by the transport section and the recording operation by the recording section, and lowers the suction power of the suction section to the medium from a first suction power to a second suction power during the recording operation;

wherein the control section controls, while the suction power of the suction section is at the first suction power, the transport section such that a tension in the transport direction of the medium downstream of the medium support section relative to the medium located on the medium support section is smaller than a force held by the suction section.

2. The image recording apparatus according to claim 1 further comprising:

a heating section heating the image recorded on the medium;

wherein a transport roller and a motor rotating the transport roller, and wherein the heating section is located between the transport roller and the medium support section in the transport direction.

3. The image recording apparatus according to claim 2;

wherein the control section controls the transport section such that a tension in the transport direction of the medium relative to the medium located on the medium support section is smaller than a force held by the motor.

4. The image recording apparatus according to claim 3;

wherein a torque generated by the motor is larger than 0 N and less than or equal to 1 N.

5. An image recording method comprising:

supporting a medium at a support surface of a medium support section provided with a suction hole;

recording by a recording section an image on the medium supported on the medium support section;

suctioning by a suction section the medium supported on the medium support section through the suction hole;

transports transporting by a transport section the medium, repeatedly carrying out the transportation operation by the transport section and the recording operation by the recording section;

lowering the suction power of the suction section to the medium from a first suction power to a second suction power during the recording operation; and decreasing, while the suction power of the suction section is at the first suction power, a tension in the transport direction of the medium downstream of the medium support section relative to the medium located on the medium support section to make the tension smaller than a force held by the suction section.

* * * * *